US006145697A

United States Patent [19]

Gudish

[11] Patent Number: 6,145,697

[45] Date of Patent: Nov. 14, 2000

[54] MEDICATION DISPENSER

[76] Inventor: William A. Gudish, 26711 Shorewood Rd., Rancho Palos Verdes, Calif. 90275

[21] Appl. No.: 09/133,543

[22] Filed: Aug. 13, 1998

[51] Int. Cl.[7] ..... G07F 11/00

[52] U.S. Cl. ..... 221/3; 221/7

[58] Field of Search ..... 221/2, 3, 7, 9, 221/13, 15, 76, 83, 82

[56] References Cited

U.S. PATENT DOCUMENTS 4,572,403 2/1986 Benaroya ..... 221/3

4,748,600 5/1988 Urquhart ..... 221/15

*Primary Examiner*—Kenneth W. Noland

*Attorney, Agent, or Firm*—Irving Keschner

[57] ABSTRACT

A device for enabling a patient to have ready access to a daily dosage of medication placed in compartments at predetermined time periods and wherein the compartments are only accessible to the patient at predetermined time periods. The device comprises an annular plate member having a plurality of medicine receiving compartments formed adjacent the periphery thereof. Specific dosages in the form of capsules or pills are sequentially placed in selected compartments. In a preferred mode, up to four compartments are loaded in sequence to provide one dosage, up to four sequences of four compartments allowing four daily dosages to be provided. An annular top cover member is positioned over the plate member, the cover member including a window or door. The annular compartment containing member is controlled in a manner such that a selected compartment is positioned at a location under the window. When the window is so located, an alarm is energized to alert the patient that the dosage in that compartment is available for use. When the door is opened, the alarm is deactivated. An indexing mechanism is provided to rotate the plate member so that the adjacent compartment is rotated beneath the window. As the plate member is rotated, the window is automatically shut before the alarm for the next compartment is energized. A locking member is provided so that only the health provider can have access to all the compartments and thus determine if the patient has complied with the specified dosage regimen.

7 Claims, 6 Drawing Sheets

MEDICATION DISPENSER

BACKGROUND OF THE INVENTION

1. Field of the Invention

The present invention provides an automatic medication dispensing device wherein an alarm notifies a user that the desired dosage is accessible and ready for use.

2. Description of the Prior Art

Pill dispensing mechanisms have been commercially available for many years. Typically, the dispensing mechanism comprises a box having dosage compartments and indicia indicating what dosage should be taken on a particular day. However, the user is still dependent on his/her memory to open the correct compartment, at the appropriate dosage time periods. This problem becomes aggravated when the recipient of the medicine is elderly or infirmed, has difficulty in remembering what medicine to take and at what time and is not eligible or financially capable of having health providers available to ensure that the proper dosage is ingested.

The conventional prior art device described hereinabove is designed to allow the user to have access to the compartments at all times, both to take the medicine and to reload the compartments. This accessibility feature has a disadvantage in that the user inadvertently could remove medicine from the wrong compartment and/or reload a compartment with the wrong medicine.

Exemplary teachings of devices that dispense medication at predetermined schedules are set out in the following patents:

1. U.S. Pat. No. 3,722,739 to Blumberg discloses a circular pill dispenser having pockets for pills formed on an annular ring, two annular members overlying the pill ring which have windows which register to expose any one pocket. A timing device prevents registering of another pocket until expiration of a pre-set time interval. The device has an audible warning device to tell a user medicine is due to be taken.
2. U.S. Pat. No. 5,323,929 to Marlar discloses a manually operated medicine dispenser having a programmable timer with a audible/visual alarm for indicating when a patient is to take medicine.
3. U.S. Pat. No. 3,369,697 to Glucksman et al discloses a timed medication dispenser for dispensing medication at pre-selected time intervals and includes sensing means responsive to the passage of a dose to a delivery station to deactivate a timer and reactivate the timer when the dose is removed from the delivery station.
4. U.S. Pat. No. 3,651,984 to Redenback discloses a birth control pill dispensing apparatus having an alarm mechanism to alert the user to take the prescribed medication.
5. U.S. Pat. No. 4,911,327 to Shepherd et al discloses a pill dispenser including means for releasing pills at predetermined intervals.
6. U.S. Pat. No. 5,044,516 to Hoar provides a medication dispensing assembly allowing a dispensing regimen of up to eight medication increments in a 24 hour day.
7. U.S. Pat. No. 5,152,422 to Springer discloses a device for dispensing predetermined pills in sequential order and includes a plurality of magazine sections for holding a plurality of vertically stacked pill containers in stacked arrays, pills being dispensed through a housing dispensing opening.

The above noted devices, although providing means for enabling a patient to take medication in a predetermined sequence, tend to be complex and expensive. In addition, a mechanism for preventing a patient from having access to the device and taking more medication than prescribed while allowing easy loading of the device is not disclosed. Further, the health provider does not have a way of determining if a dose was taken and when, thus defeating compliance regimens demanded by managed care and insurance organizations. Specifically, these groups are anxious to prevent a patient from becoming medically more dependent by not taking the proper dosage of medicine and thus reduce the attendant costs; health insurance groups likely would reduce the insurance payback to the patient if it was determined that the patient was not taking the proper medication.

What would be desired is to provide an automatic dosage dispenser device where the user is alerted a number of times daily, via an audible alarm, that a proper dosage is available for ingestion and wherein the dosage storage compartments are inaccessible to the patient but accessible to the health provider, thus effectively providing a way to ensure that the patient is in compliance with the prescribed dosage regimen.

SUMMARY OF THE PRESENT INVENTION

The present invention provides a device for enabling a patient to have ready access to a daily dosage of medication placed in compartments at predetermined time periods and wherein the compartments are inaccessible to the patient but accessible to the health care providers.

The device comprises an annular shaped plate member having a plurality of medicine receiving compartments formed adjacent the periphery of the plate member. Specific dosages in the form of capsules or pills are placed sequentially in selected compartments. In a preferred mode, up to four compartments are loaded in sequence to provide one dosage, up to four sequences of four compartments allowing four daily dosages to be provided. An annular top cover member is positioned over the annular plate member, the cover member including a window, or door. The annular compartment containing member is controlled in manner such that a selected compartment is positioned at a location under the window. When the window is so located, an alarm is energized to alert the patient that the dosage in that compartment is available for use. When the window is opened, the alarm is deactivated. An indexing mechanism is provided to rotate the plate shaped member so that the adjacent compartment is rotated so that it is beneath the window. As the plate shaped member is rotated, the window is automatically shut before the alarm for the next compartment is energized. The cover member includes a locking mechanism whereby only the health provider has access to the compartment area, allowing the health provider to ascertain whether the required medicine has been taken by the patient to provide a method of determining whether the patient is in compliance with his/her treatment plan.

The present invention thus provides an automatic medicine dispensing device which is less expensive, more reliable and more secure than devices currently available commercially and wherein patient compliance with the medicine regimen can be easily ascertained.

BRIEF DESCRIPTION OF THE DRAWING

For a better understanding of the invention, as well as other objects and further features thereof, reference is made to the following description which is to be read in conjunction with the accompanying drawing wherein.

DESCRIPTION OF THE INVENTION

Figure 1:
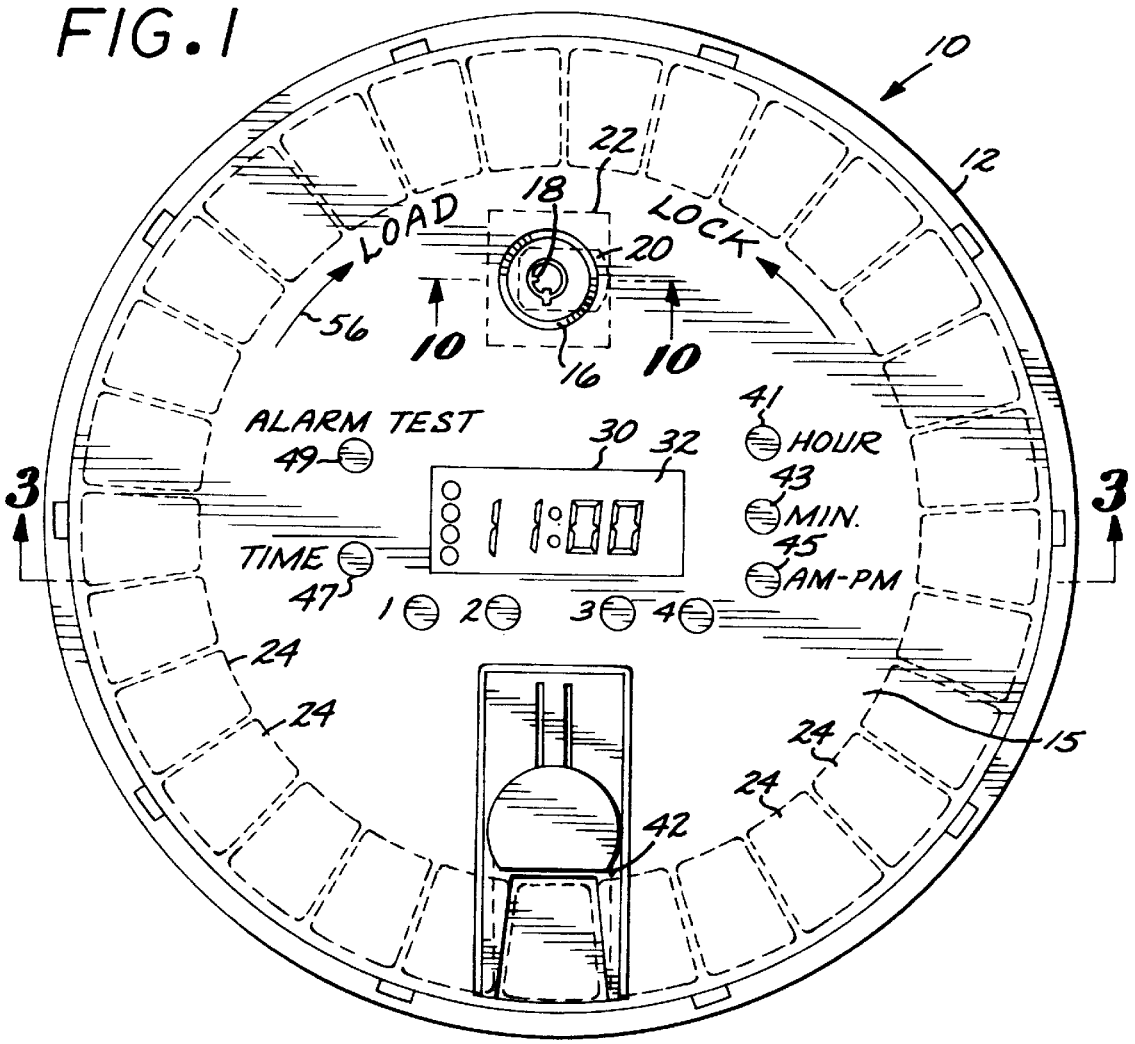
FIG. 1 is a top plan view of the dispensing device of the present invention with the dispensing window closed.
Figure 3:
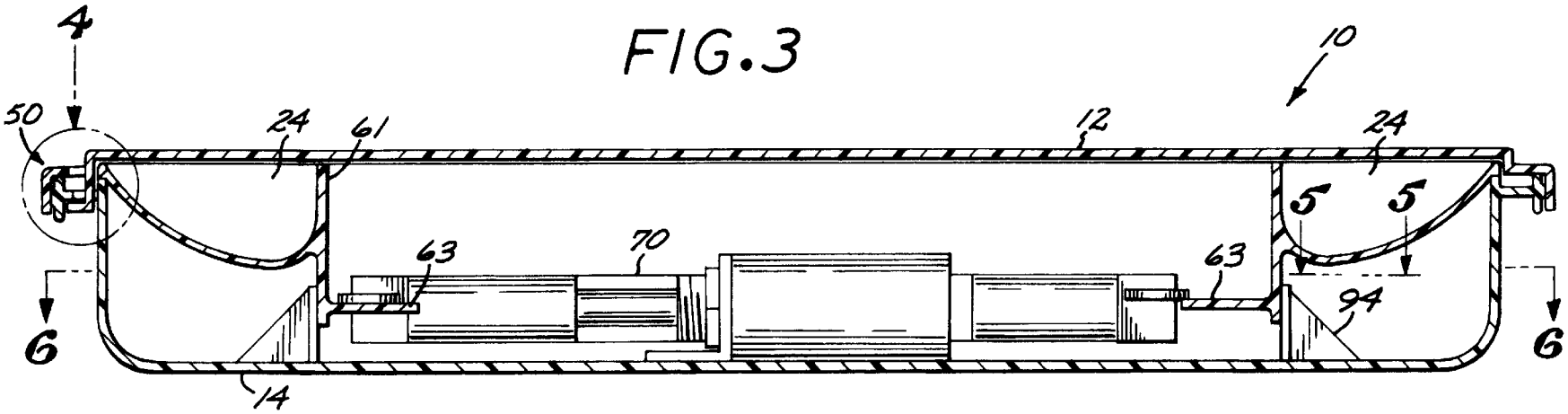
FIG. 3 is a cross-sectional view along lines 3—3 of FIG. 1 showing the dispenser drive mechanism.

Referring now to FIGS. 1 and 3, the medicine dispensing device 10 of the present invention is illustrated. An annular top cover member 12 is positioned over an annular base member 14. Cover member 12 has a locking mechanism 16 which normally prevents the cover member 12 from separating from base member 14. Locking mechanism 16 is conventional and comprises a key (not shown) insertable into key aperture 18. Rotation of the key in the locking position causes a tab 20 to engage a plemin, or cavity 22 in with base member 14, thus preventing separation of the two members. Rotation of the key in the opposite direction enables the two members to be separated. Base member 14 has a plurality of compartments, or pockets, 24 for storing patient medicine, such as pills. Although the number of compartments vary, typically they are selected to provide the patient with a periodic daily dose over a weeks time, for example.

Figure 2:
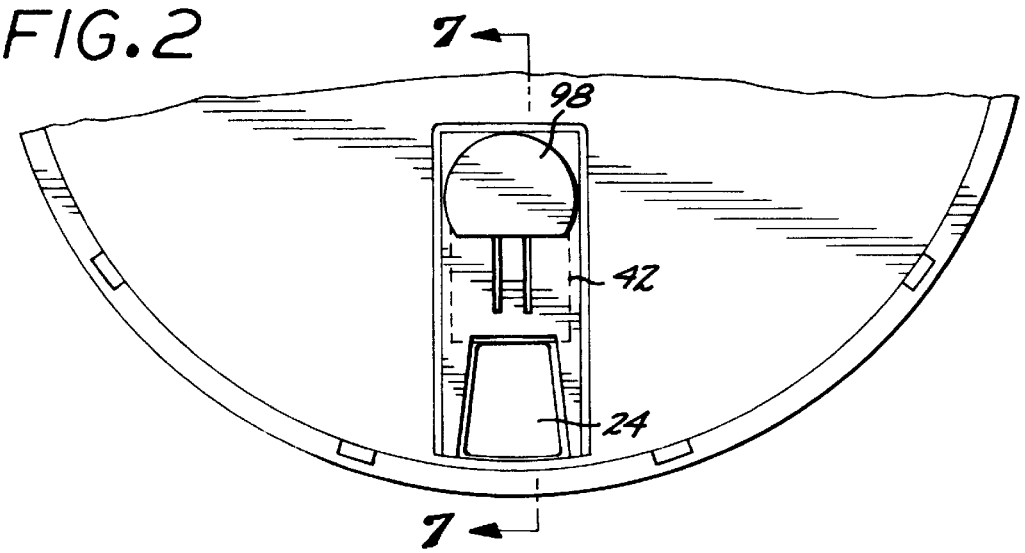
FIG. 2 is similar to FIG. 1 showing the dispensing window opened.

Top cover 12 includes an area for receiving a timing device 30, device 30 having a visual display 32 and keys, or buttons 41 and 43 to enable the system timing to be set, button 45 to set AM-PM, button 47 to enable the user to chek the set time and button 49 to enable the user to check the alarm function. The buttons are mounted on a panel 15 below top cover 12 so that access to the buttons is prevented once top cover 12 is locked. A dispensing window, or door, 42 is provided to allow a user, or patient, access to the compartment 24 thereunder and remove the medicine stored therein. As will be explained hereinafter, the window 42 is manually opened (FIG. 1 shows window 42 in the closed position; FIG. 2 shows window 42 in the open position).

Figure 4A:
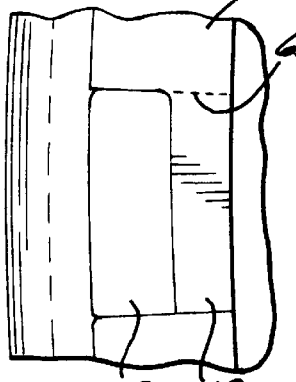
FIG. 4 is a detail showing the top cover coupled to the bottom base member and FIG. 4A is a plan view of the coupling area.
Figure 4:
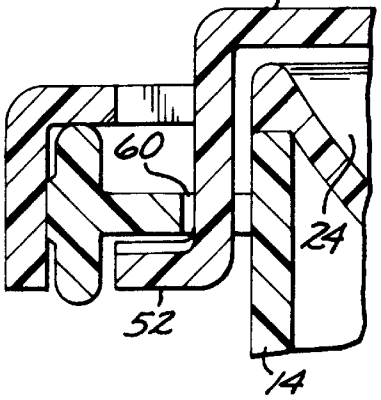

FIG. 3 is a sectional view along line 3—3 of FIG. 1. Top cover 12 is coupled to base member 14 via mechanism 50 (shown in detail in FIGS. 4 and 4A). Top cover member 12 has an angled, or tab, portion 52 extending therefrom and inserted into hole 60 formed in body 14 as shown in FIG. 4. The device 10 is opened by first unlocking lock mechanism 16. The health provider then places both hands on device 10 and rotates top cover 12 in the direction of arrow 56 while keeping base member 14 stationary. The rotation will stop, allowing the top cover, or lid, 12 to be separated from base member 14 in a uplifting motion.

In particular, upon clockwise rotation, tab portion 52 is positioned under the narrow part 62 of slot 64 and abuts against stop 65 formed in body member 14 preventing further rotation.

Figure 6:
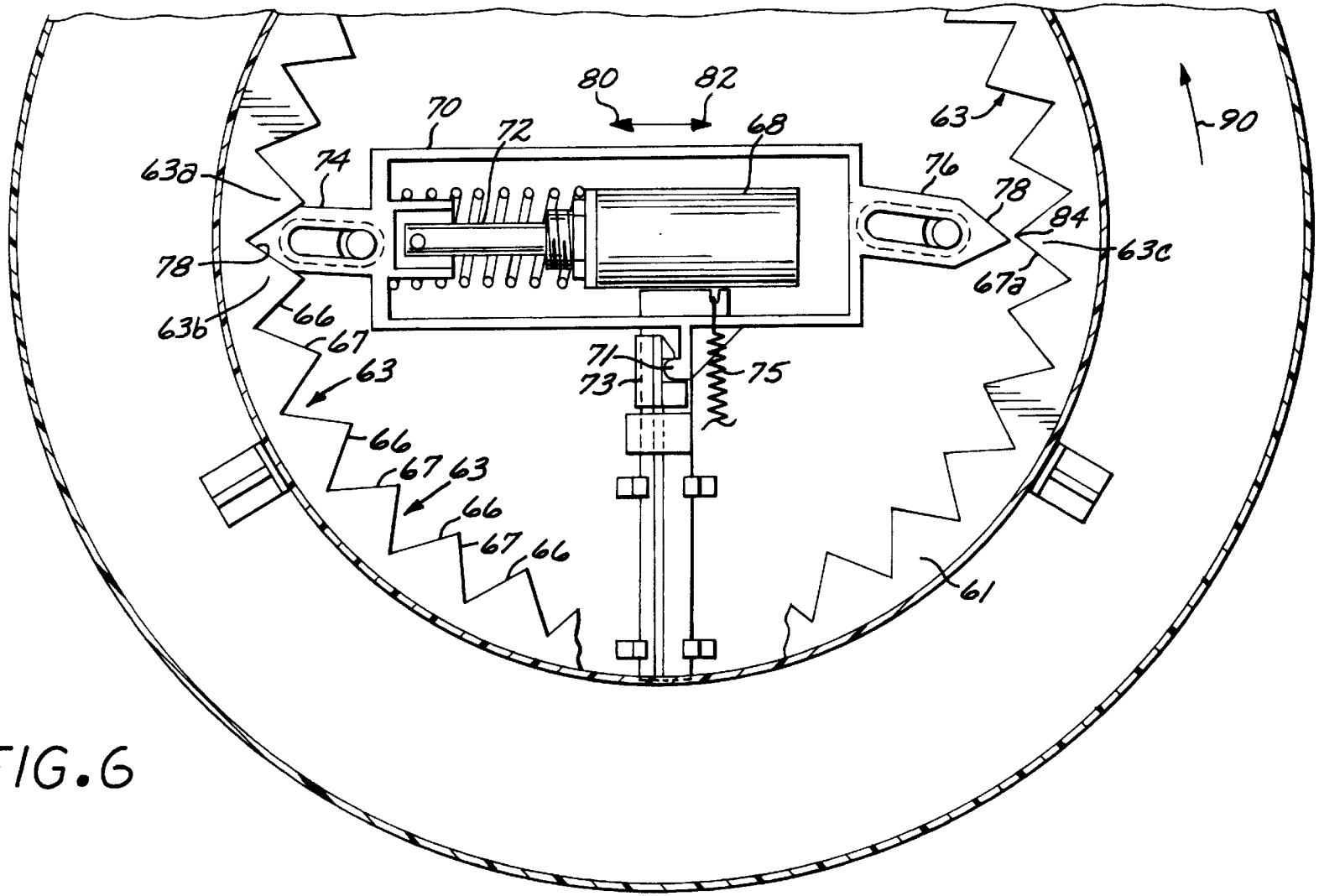
FIG. 6 is a cross-sectional view along line 6—6 of FIG.

FIGS. 3 and 6 further illustrates the index driving mechanism for device 10. In particular, an annular member 61 containing compartments 24 has a series of teeth 63 positioned around the periphery thereof. Each tooth 63 has inwardly extending portions 66 and 67 forming a valley therebetween. A solenoid member 68, positioned in frame member 70, has a movable arm member 72. Member 70 has projections 74 and 76 formed at opposite ends thereof, each projection having end portions 78 shaped to be positioned in the valley portions of each tooth 63. When solenoid 68 is energized by a controller 132 (shown in FIG. 12), frame member 70 moves in the direction of either arrow 80 or 82; in the direction of arrow 80 and in the position shown in FIG. 6, end position 78 of projection 74 extends into the valley portion formed between teeth 63*a* and 63*b*; projection 78 of opposite end 76 is positioned adjacent the crest 84 of tooth 63*c*. FIGS. 3 and 6 illustrate the situation when the compartment containing member is prevented from moving, i.e. when a particular compartment is positioned under window 16. When the door is opened and the medicine removed, the controller 132 energizes solenoid 68 causing arm 72 (and connected frame member 70) to move in the direction of arrow 82. In this mode, extension 78 of projection 74 is withdrawn from valley formed between teeth 63*a* and 63*b* while extension 78 of projection 76 engages surface 67*a* of tooth 63*c*. As the tip of extension 78 slides down inclined, or ramped, surface 67*a*, the tooth containing member is indexed on the direction of arrow 90, the arc of rotation for each indexing action corresponding to the distance between adjacent compartments 24. When the device 70 is activated, tab 71, connected thereto, moves in the direction of arrow 82, releasing mechanism 73. This in turn allows door 42 to automatically return to the closed position. A spring 75 provides a maintaining force to tab 71.

Figure 5:
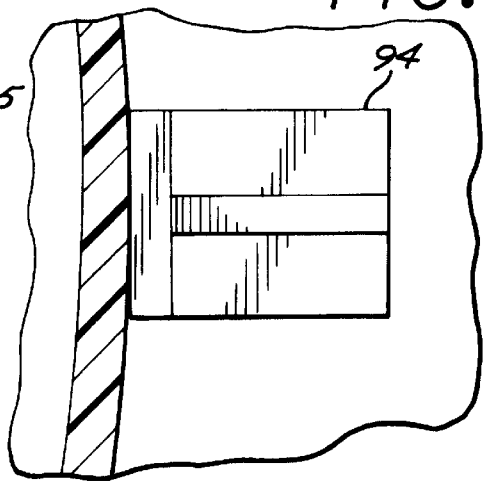
FIG. 5 is a view along line 5—5 of FIG. 3.

FIG. 5 illustrates guide mechanism 94 which functions to maintain the container annular member in position after the indexing operation.

Figure 7:
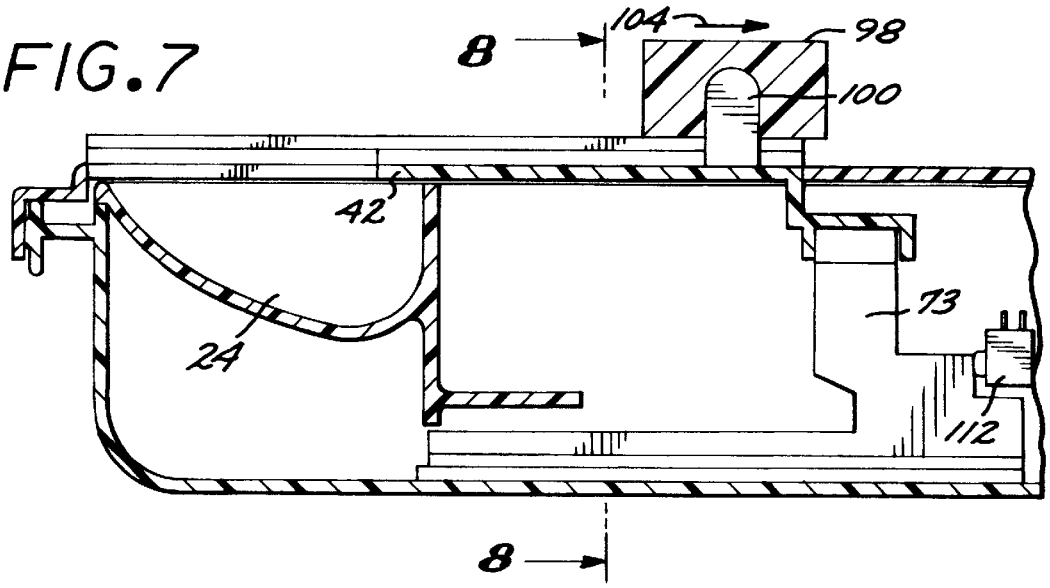
FIG. 7 is a cross-sectional view along line 7—7 of FIG. 2.
Figure 8:
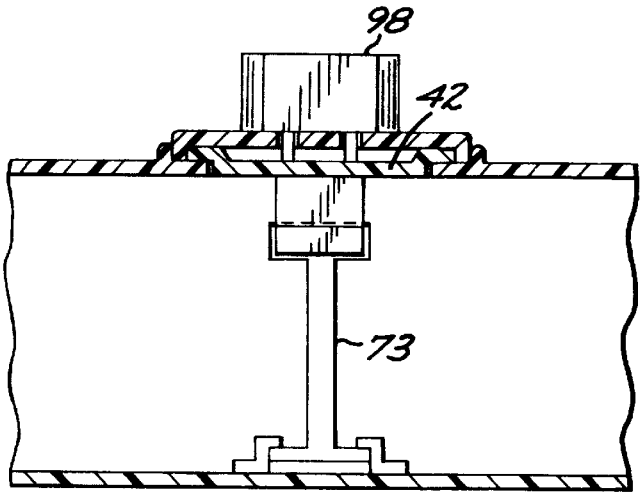
FIG. 8 is a cross-sectional view along line 8—8 of FIG. 7.
Figure 9:
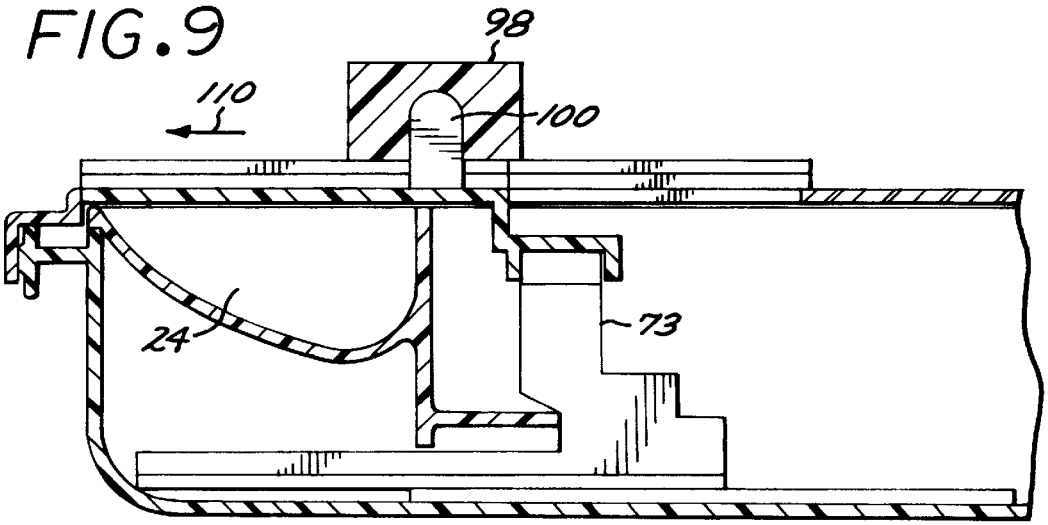
FIG. 9 is similar to FIG. 7 showing the window in its closed position.

FIGS. 7 and 9 illustrates in more detail the operation of window 42. FIG. 7 illustrates the situation when window 42 is opened by a patient pulling on knob 98, knob 98 engaging post 100. When knob 98 is pulled in the direction of arrow 104, mechanism 73, coupled to post 100, is also moved in the direction of arrow 104 and engages a ratchet stop member to hold the window in its open position. After the medicine is removed from a compartment 24, the annular member starts to index to the next adjacent compartment when microcontroller 132 activates solenoid 68. At the start of the movement, mechanism 73 is automatically released and window 42 moves in the direction of arrow 110 (FIG. 9), thus covering the compartments/top cover as the indexing continues. A door switch 112 is coupled to mechanism 73 as illustrated.

In operation, a preset alarm rings and lights flash for the preset time or times, up to four times daily. When the alarm rings, base member 14 rotates such that a new compartment 24 is positioned under the access door 42. To turn the alarm off the door 42 must be opened (the switch 112 is mounted to a PCB and coupled to mechanism 73). This action also exposes the compartment, the door 42 staying open until the next time a dosage is required, allowing the user an easy visual check that all the material has been used and also assuring that no medicine is unavailable until the proper time. When door 42 opens, it is locked in the open position by mechanism 73. When member 61 is indexed, mechanism 73 is released, door 42 closes and the alarms are activated.

The initial step for setting device 10 for operation is set forth herinafter.

OPENING—Lock mechanism 16 is first unlocked. Looking at the instructional arrow on the cover, both hands are placed on device 10 and the top rotated in the indicated clockwise direction keeping the lower half or bottom from moving. The rotation will stop, allowing the top or lid to be separated from the bottom in a uplifting motion.

A conventional timing/alarm device (not shown) is provided. The operation thereof is as follows:

SETTING TIME—The time button 47 is pressed causing the digits to blink. The hour button 41 is then pressed until the proper hour is displayed. The minute button 43 is then pressed until the proper minute is displayed. The AM-PM button 45 is then pressed, changing the dots in the center of the field, one dot for AM, two dots for PM. If the time is proper, the time button 47 is pressed again, the digits no longer blinking, the time thus being set.

SETTING ALARM(S)—The 1 button (FIG. 1) is pressed once. This causes the digits and the first dot (lower right in the display) to blink. The hour button 41 is then pressed until the desired hour is displayed. The minute button 43 is then pressed until the desired minutes are displayed. The AM-PM button 45 is then pressed until the desired portion of the day is indicated. After checking the alarm time, the 1 button is pressed again to restore the alarm time.

To set a second alarm, the 2 button is pressed. This causes the digits and the second dot to blink. Following the same procedure as with the first alarm, the hour button is pressed, followed by the minute button, followed by the AM-PM button, and finally the 2 button after checking the blinking digits for the proper second alarm time. Setting the number 3 alarm and the number 4 alarm are done in a similar manner.

The device 10 has the capability of four alarms only if there are four dots showing. It is not necessary that any number of alarms are set, only the one(s) needed requiring the appropriate button number (1, 2, 3 and/or 4) being pressed. The alarm consists of a flashing light and a sound will signal continuously for 60 seconds or until deactivated. If after 60 seconds the unit is not deactivated, a reminder alarm will be initiated every 3 minutes for 30 seconds.

Figure 10:
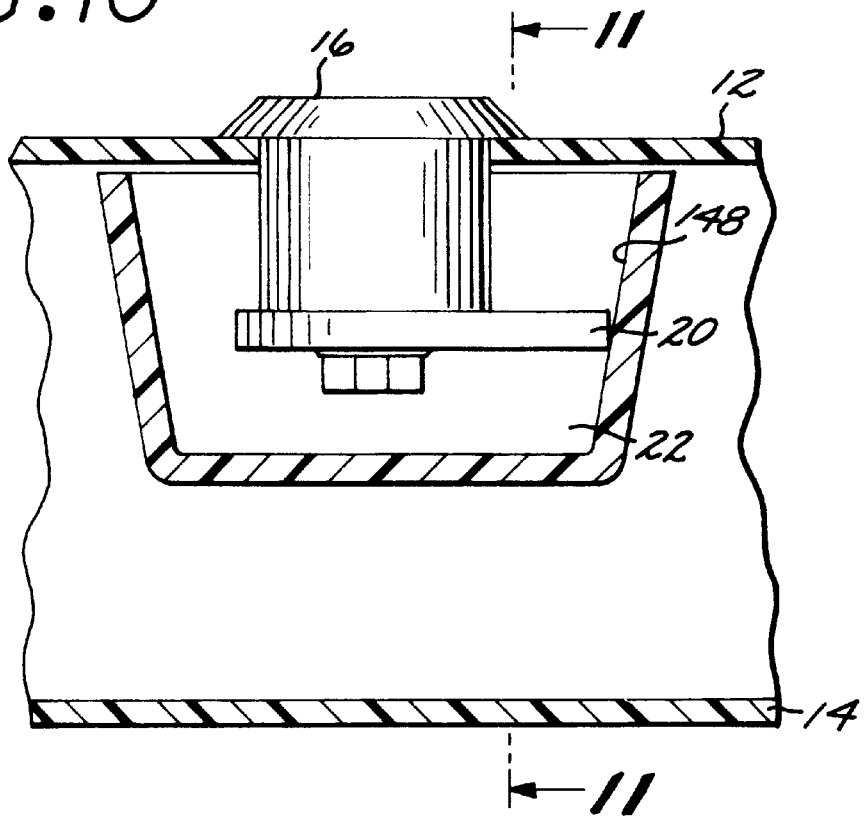
FIG. 10 is a sectional view along line 10—10 of FIG. 1.
Figure 11:
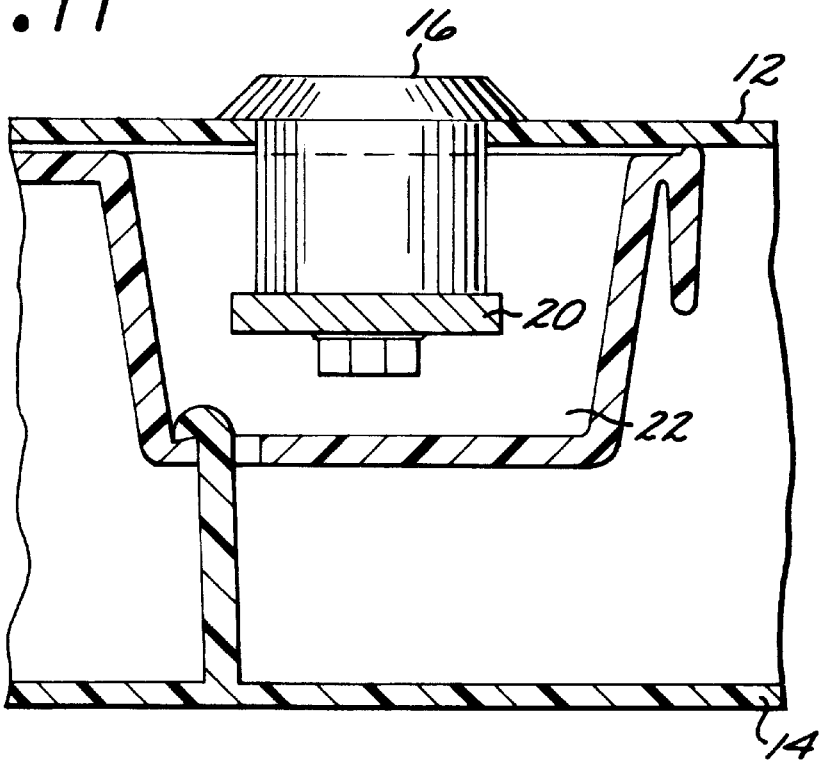
FIG. 11 is a sectional view along line 11—11 of FIG. 10.

FIGS. 10 and 11 illustrate the operation of locking mechanism 16. In particular, plemin, or cavity, 22 is formed in base member 14 and locking mechanism 16 is positioned thereover as illustrated. Rotation of tab 20 to the position shown wedges tab 20 (and thus cover 12) against internal cavity surface 148 preventing relative motion of cover 12 and base member 14, locking the two components together.

Figure 12:
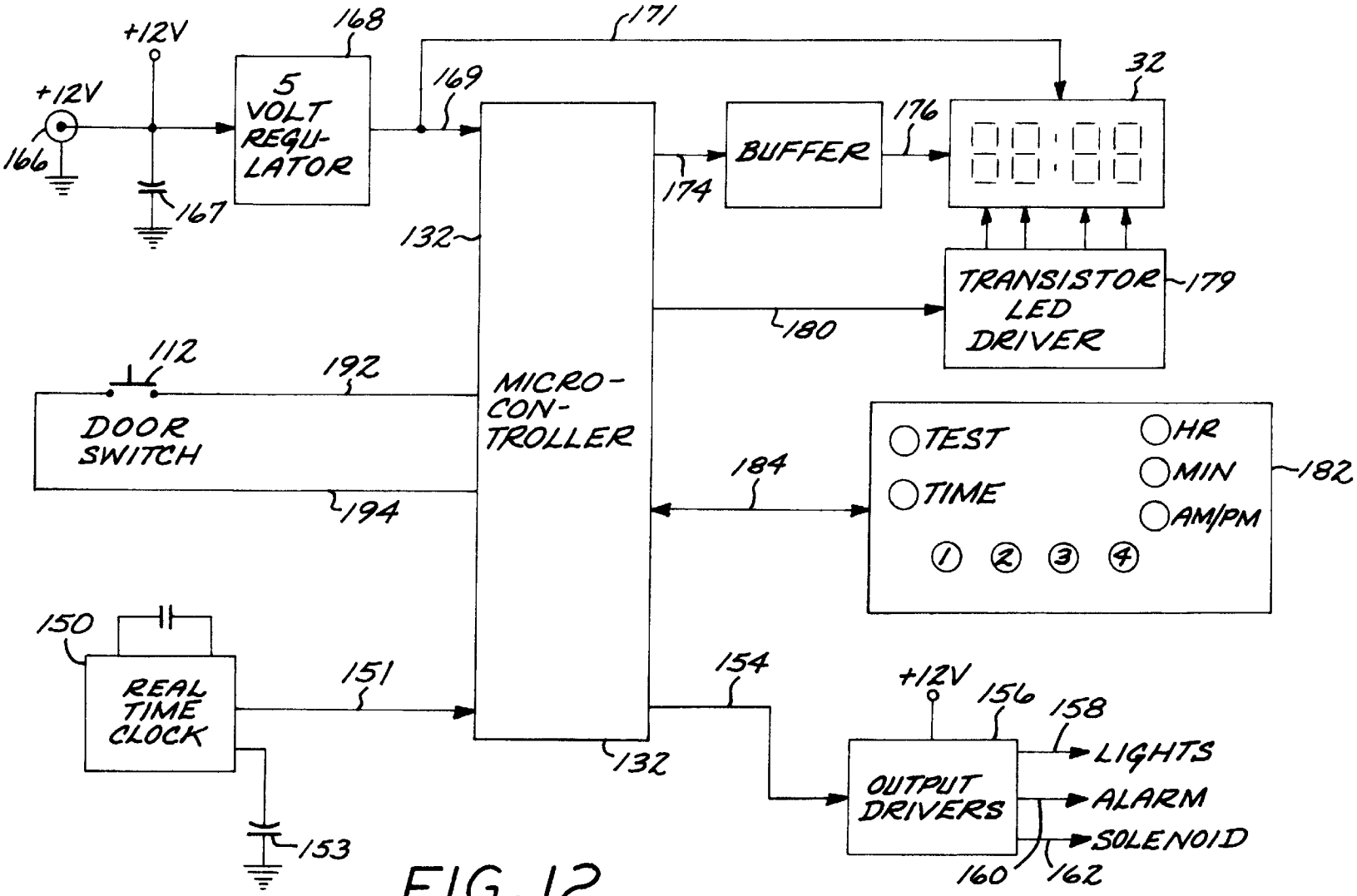
FIG. 12 is a simplified block diagram of the system of the present invention.

FIG. 12 is a simplified block diagram of the present invention. A real time clock 150 is coupled to microcontroller 132 (Model No. PIC 16C57 or equivalent manufactured by Intel Corporation, Sunnyvale, Calif.) via lead 151. A memory backup capacitor 153 is coupled between clock 150 and ground as illustrated. One output from microcontroller 132 on lead 154 is coupled to output drivers 156, the output of which is coupled to the system lights via lead 158, the system alarm on lead 160 and to the system solenoid 68 on lead 162. A 12 volt DC source 166 powers the output drivers 156 and is coupled to 5 volt regulator 168. An energy storage capacitor 167 is connected between the output of source 166 and ground as illustrated. The output of regulator 168 is coupled to microcontroller 132 and to LED display 32 via leads 169 and 171, respectively. The output of microcontroller 132 is coupled to buffer device 172 via lead 174, the output of buffer device 172 in turn being coupled to LED display 32 via lead 176. The output of microcontroller 132 is also coupled to transistor LED drivers via 179 lead 180. The time/alarm set buttons, represented by blocl 182, and microcontroller 132 are interconnected via lead 184. Door switch 112 is coupled to microcontroller 132 via leads 192 and 194 and initates operation of the automatic door closing feature after the door is manually opened.

In operation, microcontroller 132 is first initialized and the user then establishes the dosage time regimen by activating the switches shown in block 182 as described hereinabove. When the first (and subsequent) dosages are to be taken, microcontroller 132, real time synchronized by clock 150, provides output signals to drivers 156, causing the system lights and audible alarm to be energized to alert the user that the dosage is available for use. After door 42 is closed, switch 112 causes microcontroller 132 to energize the solenoid output lead 162, thereby activating solenoid 68 as descibed hereinabove.

The light/audible alarm mechanisms have not been illustrated, the connection and operation thereof being conventional.

The present invention thus provides a relatively simple, inexpensive medicine dispensing device wherein a health provider can ascertain whether a patient is in compliance with a prescibed dosage regime.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A medicine dispensing device for patient usage comprising:

a base member having an annular shaped plate member with a plurality of compartments formed on its outside periphery positioned therein, the inner surface of said plate member having a predetermined shape which is operatively coupled to a driving member, a driving member positioned within said base member such that is operatively engages the predetermined shape of the inner surface of said plate member;

means for energizing said driving member at predetermined times to rotate said plate member a predetermined distance;

a top cover member positioned over said base member, said top cover member having a window movable between first and second positions, said driving member indexing said plate member such that a first compartment having medicine therein is at a first position under said window; and a locking mechanism for securing said top cover member to said base member in a manner whereby the patient is prevented from having access to medicine stored in said compartments.

2. A medicine dispensing device comprising:

a base member having an annular shaped plate member with a plurality of compartments formed on its outside periphery positioned therein, the inner surface of said plate member having a predetermined shape which is operatively coupled to a driving member, a driving member positioned within said base member such that is operatively engages the predetermined shape of the inner surface of said plate member;

means for energizing said driving member at predetermined times to rotate said plate member a predetermined distance;

a top cover member positioned over said base member, said top cover member having a window movable between first and second positions, said driving member indexing said plate member such that a first compartment having medicine therein is at a first position under said window, said driving member subsequently moving said plate member such that a second compartment, adjacent to said first compartment, will be positioned under said window; and alarm means, an alarm being generated when said first compartment is at said first position.

3. The device of claim 2 wherein said alarm is reenergized as the plate member moves in a manner such that first compartment is no longer positioned under said window, said window being automatically closed when the plate member is moved such that said first compartment is no longer positioned under said window.

4. A medicine dispensing device comprising:

a base member having an annular shaped plate member with a plurality of compartments formed on its outside periphery positioned therein, the inner surface of said plate member having a predetermined shape which is operatively coupled to a driving member, a driving member positioned within said base member such that is operatively engages the predetermined shape of the inner surface of said plate member, said inner surface of said plate member comprising a plurality of ramp shaped teeth, each tooth having crest and valley portions, and said driving member comprises a solenoid driven actuator having first and second end portions;

means for energizing said driving member at predetermined times to rotate said plate member a predetermined distance; and a top cover member positioned over said base member, said top cover member having a window movable between first and second positions, said driving member indexing said plate member such that a first compartment having medicine therein is at a first position under said window.

5. The device of claim 4 wherein said first and second end portions have ramp shaped members, said first end portion being inserted within said valley portion of one of said teeth to prevent said disk member from rotating.

6. The device of claim 5 wherein the second end portion moves down the ramp portion of one of said teeth as said first portion is withdrawn from said valley portion, the movement of said second portion down said ramp surface causing said plate member to be indexed whereby said second compartment is moved to said second position.

7. A medicine dispensing device comprising:

a base member having an annular shaped plate member with a plurality of compartments formed on its outside periphery positioned therein, the inner surface of said plate member having a predetermined shape which is operatively coupled to a driving member, a driving member positioned within said base member such that it operatively engages the predetermined shape of the inner surface of said plate member;

means for energizing said driving member at predetermined times to rotate said plate member a predetermined distance;

a top cover member positioned over said base member, said top cover member having a window movable between first and second positions, said driving member indexing said plate member such that a first compartment having medicine therein is at a first position under said window; and alarm means, an alarm being generated when said first compartment is at said first position, said alarm being deenergized when said window is moved to said first position exposing the medicine in said first compartment.

* * * * *